US006039771A

United States Patent [19]

Selvidge et al.

[11] Patent Number: 6,039,771

[45] Date of Patent: Mar. 21, 2000

[54] FORMULATION AND METHOD OF PREPARATION OF ENERGY FORTIFIED DIESEL FUEL

[75] Inventors: Charles W. Selvidge; Dennis A. Vauk, both of Wichita, Kans.

[73] Assignee: KRC-GP, Inc., Wichita, Kans.

[21] Appl. No.: 09/065,237

[22] Filed: Apr. 23, 1998

[51] Int. Cl.[7] ..... C10L 1/08

[52] U.S. Cl. ..... 44/311; 44/628; 208/15; 208/347; 585/13; 585/14

[58] Field of Search ..... 585/13, 14; 208/15, 208/347; 44/311, 628

[56] References Cited

U.S. PATENT DOCUMENTS

| | | | |
|---|---|---|---|
| 4,501,653 | 2/1985 | Hammer | 208/89 |
| 4,755,277 | 7/1988 | Breuker et al. | 208/40 |
| 5,656,039 | 8/1997 | Webster, III | 44/300 |
| 5,718,820 | 2/1998 | Morel et al. | 208/15 |
| 5,792,339 | 8/1998 | Russell | 208/15 |

OTHER PUBLICATIONS

Fritz, Steven G., et al., "A Single Cylinder Medium Speed Diesel Engine Research Facility," Society of Automotive Engineers, Inc., 1988, pp. 1–9.

Wakenell, J.F., et al., "Alternative Fuels for Medium Speed Diesel Engines," Seventh Research Phase Final Report R678, Oct. 1987, pp. 1–138, and appendices A–F.

*Primary Examiner*—Jerry D. Johnson
*Attorney, Agent, or Firm*—Shook, Hardy & Bacon LLP

[57] ABSTRACT

An energy fortified diesel fuel is provided containing a hydrocarbon additive wherein greater than 50% vaporizes at or above about 650° F. and diesel fuel of which about 90% of the diesel fuel vaporizes at or below about 640° F. or about 95% of the diesel fuel vaporizes at or below about 698° F. This energy fortified diesel fuel is made by distilling a heavy hydrocarbon fraction such as slurry oil or heavy cycle oil obtained from an FCC unit or a heavy hydrocarbon fraction obtained from a steam cracker unit at a temperature of between about 500 and 750° F. and at a pressure of between about 1 mm Hg and 10 psig to remove contaminants, removing distillate from this distillation, and mixing the distillate with diesel fuel, wherein about 90% of the diesel fuel vaporizes at or below about 640° F. or about 95% of the diesel fuel vaporizes at or below about 698° F., to form an energy fortified diesel fuel. This energy fortified diesel fuel is a desirable fuel for off highway heavy duty and "very" heavy duty compression ignition engines.

36 Claims, No Drawings

FORMULATION AND METHOD OF PREPARATION OF ENERGY FORTIFIED DIESEL FUEL

BACKGROUND OF THE INVENTION

The present invention relates to a new formulation of fuel and a process for making such fuel. More specifically, the fuel of the present invention is an energy fortified diesel fuel which is useful in off-highway applications.

Diesel engines having different fuel requirements can be grouped into three main categories, namely, on-highway compression ignition engines, off-highway heavy duty compression ignition engines, and off-highway "very" heavy duty compression ignition engines. Off-highway heavy duty compression ignition engines operate at lower speeds and have fewer load changes than on-highway compression ignition engines. An example of such an engine is a locomotive engine. Off-highway "very" heavy duty compression ignition engines operate in the least demanding environment of these three categories of engines. They operate at slower speeds and have fewer load changes than off-highway heavy duty compression ignition engines. Marine diesel engines and electric power generation engines are examples of off-highway "very" heavy duty compression ignition engines.

Currently, in choosing a diesel fuel for off-highway heavy duty compression ignition engines, one must choose between two non-optimum extremes. One extreme is on-highway diesel fuel, which has good compression ignition behavior, as indicated by its high cetane number (or equivalently, its cetane index, which is more commonly measured).

The cetane number of a diesel fuel is determined by use of a laboratory single cylinder compression ignition engine by comparison of the compression ignition delay of the sample fuel with blends of cetane and heptamethylnonane, where cetane (n-hexadecane, $C_{16}H_{34}$) is arbitrarily assigned a number of 100 and heptamethylnonane is assigned a number of 0. The cetane number method is published as ASTM D 613: Test Method for Cetane Number of Diesel Fuel Oil. Alternatively, the cetane index (ASTM D976 Test Method for Calculated Cetane Index of Distillate Fuels) gives a good approximation of the cetane number based on the distillation and density of the diesel fuel.

In the United States, the Environmental Protection Agency (EPA) specifies that on-highway diesel fuel have a cetane index of at least 40. European standards require the cetane number for on-highway diesel fuel to be a minimum of 50. On-highway diesel fuel is further characterized by a high API gravity and, accordingly, a low specific gravity and a relatively low volumetric energy density (Btu/gallon). All API gravity and volumetric energy density numbers throughout this patent application are measured at about 60° F. and about 1 atm. Specifically, on-highway diesel fuel has an API gravity of about 30 or greater and a volumetric energy density of about 133,000 Btu/gallon or less. Much of on-highway diesel fuel has an API gravity greater than 35 and a volumetric energy density less than 130,000 Btu/gallon. Still further, at least 90% of on-highway diesel fuel must vaporize at or below 640° F. according to standards set by the American Society of Testing and Materials (ASTM). At least 95% of on-highway diesel fuel must vaporize at or below 698° F., according to European standards. One example of an on-highway diesel fuel is one that meets ASTM D 975 standards. Percentages referred to in this patent application are expressed in terms of volume percent unless otherwise noted.

The high cetane number required for on-highway diesel fuels is not necessary for off-highway heavy duty and "very" heavy duty compression ignition engines. For instance, according to the American Association of Railroads (AAR), locomotive diesel engines can successfully operate with fuels having cetane numbers as low as 32 or lower. Also, AAR studies indicate that diesel fuel used in locomotive engines can have a higher distillation range than that specified by ASTM for on-highway diesel fuel. Thus, using on-highway diesel fuel for off-highway applications results in unnecessary fuel costs since on-highway diesel fuel does not provide benefits to off-highway compression ignition engines by having a higher cetane number or lower distillation range than necessary for off-highway operation. Still further, as determined by experiments in developing the present invention, the high API gravity of on-highway diesel fuel is not necessary for off-highway applications.

The other non-optimum extreme for use in off-highway compression ignition engines is bunker fuel or bunker fuel blends. Bunker fuel is the bottom of the barrel product in a refinery. It has a very high boiling range including a substantial portion boiling higher than 900° F. It has a low API gravity, which is typically about 10, and thus, it has a high volumetric energy density of about 145,000 Btu/gallon. Because of its extremely high volumetric energy density, it provides excellent fuel economy.

Bunker fuel is conventionally used in "very" heavy duty compression ignition engines, such as marine diesel engines, which run at low speeds with relatively steady load requirements. However, bunker fuel or even blends of bunker fuel with typical on-highway diesel fuel is not suitable for on-highway applications and higher speed off-highway applications, such as off-highway heavy duty compression ignition engines like locomotive engines, which operate at higher speeds and have more transient load requirements than "very" heavy duty compression ignition engines.

The disadvantages caused by bunker fuel and bunker fuel blends when used in on-highway compression ignition engines and off-highway heavy duty compression ignition engines outweigh the fuel economy provided in these applications. These disadvantages derive from its formulation since certain impurities found in bunker fuel, such as ash (non-combustibles), asphaltenes, particulates (insolubles), Ramsbottom carbon (correlated with Conradson carbon), metals, high boiling compounds, and non-vaporizable components, can be detrimental to performance and durability. The relatively high quantities of ash found in bunker fuel result from compounds which dissolve in the heavy oil fractions of the bunker fuel or tramp contaminants that enter the fuel during processing from the well to the end user. Particulates and gums, which are also found in bunker fuel in relatively high quantities, collapse fuel filters and cause filter and line plugging. Still further, bunker fuel has a high Ramsbottom carbon value, as compared with typical on-highway diesel fuel, which has a negligible amount of Ramsbottom carbon. Bunker fuels also have relatively high viscosity, and therefore, their atomization in compression ignition fuel injectors is less efficient than lower viscosity diesel fuels.

The compression ignition behavior deficiencies caused by bunker fuels do not preclude their application for the "very" heavy duty engines because of the unique speed and load requirements of these engines. However, for on-highway compression ignition engines and off-highway heavy duty compression ignition engines that operate at higher speeds and experience transient load requirements as a significant part of their duty cycles, bunker fuels do not provide acceptable compression ignition behavior, and they can form relatively large amounts of soot and otherwise give unacceptable performance, such as compromising durability and shortening the life of engine components. Thus, in choosing between using on-highway diesel fuel and bunker fuel for off-highway heavy duty compression ignition engines, typically, on-highway diesel fuel is chosen.

Still further, on-highway diesel fuel has been blended with light cycle oil (LCO) wherein greater than about 50% of the LCO vaporizes at temperatures less than 550° F. Since this blend does not upgrade the LCO's value significantly, there are only slight cost advantages, if any, with using LCO. Still further, LCO only has slightly more volumetric energy density than on-highway diesel fuel. LCO's API gravity is typically about 13.7 or higher, and its volumetric energy density is typically about 143,000 Btu/gallon or less. Thus, large amounts of LCO must be added to on-highway diesel fuel to increase its volumetric energy density substantially. The addition of large amounts of LCO sufficient to provide significant increases in volumetric energy density distorts the performance characteristics of the diesel fuel by greatly compromising its stability and increasing its potential to plug filter systems. Sufficient amounts of stabilizers cannot be added to the LCO and diesel fuel blend to make it stable. Thus, this LCO blend has not been found to be an acceptable diesel fuel alternative. Furthermore, many in the industry would expect that heavier cycle oil, when combined with on-highway diesel fuel, would have a greater tendency for sludge and gum formation because of its higher molecular weight and higher boiling point, and thus, it would be even less stable than LCO blends.

In order to overcome the deficiencies found with conventional fuels used in off-highway compression ignition engines, a fuel which can be used in all types of off-highway vehicles including both off-highway heavy duty and "very" heavy duty compression ignition engines and a method for making such fuel are needed. A fuel with a high volumetric energy density having acceptable compression ignition performance, a low amount of contaminants, and a cetane number and an API gravity optimized for off-highway use and a method for making such fuel in a cost effective manner are needed.

SUMMARY OF THE INVENTION

It is an object of the present invention to provide an energy fortified diesel fuel with acceptable compression ignition behavior and a process for making such fuel so that less fuel is required for off-highway combustion ignition engines and thus energy costs for off-highway vehicles may be decreased.

It is a further object of the present invention to provide a fuel which has lower production costs than diesel fuel conventionally used in off-highway applications so that fuel may be provided at a lower cost.

It is still another object of the present invention to provide a fuel having a high flash point and a process for making such fuel so that the fuel can be handled safely.

Another object of the present invention is to provide a fuel which has good thermal and oxidative stability and a process for making such fuel so that the fuel is resistant to sludge formation.

Still another object of the present invention is to provide a fuel containing no more than negligible amounts of ash, particulates, gums and other contaminants and a process for making such fuel so that the fuel may be used in off-highway vehicles which operate at relatively high speeds and experience transient load requirements as a significant part of their duty cycles.

According to the present invention, the foregoing and other objects are achieved by an energy fortified diesel fuel comprised of a hydrocarbon additive wherein greater than about 50% of this hydrocarbon additive vaporizes at or above about 650° F. and diesel fuel of which about 90% vaporizes at or below about 640° F. or about 95% vaporizes at or below about 698° F. This energy fortified diesel fuel is made by removing a heavy hydrocarbon fraction, such as slurry oil, heavy cycle oil, or another product from the bottoms of a Fluid Catalytic Cracker (FCC) unit or a steam cracker unit; distilling this heavy hydrocarbon fraction to remove contaminants; removing distillate from this distillation; and mixing the distillate with diesel fuel of which about 90% vaporizes at or below about 640° F. or about 95% vaporizes at or below 698° F.

Additional objects, advantages, and novel features of the invention will be set forth in part in the description which follows, and in part will become apparent to those skilled in the art upon examination of the following, or may be learned from practice of the invention. The objects and advantages of the invention may be realized and attained by means of the instrumentalities and combinations particularly pointed out in the appended claims.

DETAILED DESCRIPTION OF THE PREFERRED EMBODIMENT

The energy fortified diesel fuel of the present invention is comprised of a hydrocarbon additive wherein greater than about 50% of this hydrocarbon additive vaporizes at or above about 650° F. and diesel fuel of which about 90% vaporizes at or below about 640° F. or about 95% vaporizes at or below 698° F. The hydrocarbon additive has a greater boiling point and higher carbon to hydrogen ratio than conventional on-highway diesel fuel, which is used in off-highway heavy duty compression ignition engines. In many cases, greater than 50% of this hydrocarbon additive vaporizes at or above about 670° F. Still further, in a significant number of cases, greater than 50% of this hydrocarbon additive vaporizes at or above about 700° F. In addition, this hydrocarbon additive, preferably, has a carbon to hydrogen ratio of between about 0.5 and 1.0, and most preferably, it is greater than about 0.8. Furthermore, the volumetric energy density of the hydrocarbon additive is higher than the volumetric energy density of bunker fuel and substantially higher than that of conventional on-highway diesel fuel. Specifically, its volumetric energy density is greater than about 145,000 Btu/gallon. Preferably, the volumetric energy density of the hydrocarbon additive of the present invention is between about 148,000 and 154,000 Btu/gallon.

Preferably, the diesel fuel component of the energy fortified diesel fuel of the present invention has a flash point of about 125° F. or greater, a sulfur content of no more than about 0.05 weight %, a No. 3 maximum corrosion, a cetane number of at least about 40, a viscosity of between about 1.9 and 4.1 cst at 100° F., a maximum ash content of about 0.01 weight %, and a Ramsbottom carbon of no more than about 0.35 weight % for the 10% bottoms residue. The corrosion test referenced is the ASTM D 130 Test Method for Detection of Copper Corrosion from Petroleum Products by the Copper Strip Tarnish Test. The specifics of this method are available in the Annual Book of ASTM Standards, Vol. 05.01. Most preferably, the diesel fuel component approximately meets all requirements specified for ASTM D 975 type diesel fuel, or it approximately meets European on-highway diesel fuel specifications.

Although the energy fortified diesel fuel of the present invention can consist only of the hydrocarbon additive and diesel fuel since these two components form a stable mixture, a stabilizer may also optionally be added to further enhance the fuel's stability and resistance to sludge formation and to prevent the formation of gums which plug filters. An antioxidant stabilizer, an oxidation inhibitor or any other stabilizer may be added. One example of such a stabilizer is Octel FAO 31 A, an antioxidant stabilizer, which is particularly effective for imparting excellent stability. It is manufactured by Octel America, Inc., 200 Executive Drive, Newark, Del. 19702, telephone number (800) 441-9547. The stabilizer may be combined with the energy fortified diesel fuel in quantities of about 50 pounds or less per 1,000 barrels of energy fortified diesel fuel. The barrel referred to throughout this patent application is a standard 42 gallon barrel. Preferably, it is combined in quantities of about 5 to 10 pounds of stabilizer per 1,000 barrels of energy fortified diesel fuel. Most preferably, about 7.5 pounds of Octel FAO 31 A is added per 1,000 barrels of energy fortified diesel fuel.

The energy fortified diesel fuel of the present invention has a cloud point and a pour point which meet typical requirements for off-highway heavy duty compression ignition engines. The cloud point and pour point may also be lowered where necessary. The cloud point can be lowered by adding a small amount of light cutter or ASTM No. 1 diesel fuel (meeting ASTM D 975 specifications for classification as No. 1 diesel fuel) to the energy fortified diesel fuel. The pour point can be lowered by adding a pour point depressant or ASTM No. 1 diesel fuel to the energy fortified diesel fuel.

Still further, the color of the energy fortified diesel fuel of the present invention is similar to the color of ASTM D 975 type diesel fuel. However, dye may optionally be added. For example, red dye meeting specifications outlined by the Internal Revenue Service may be added in quantities of about 9 pounds or greater per 1000 barrels of diesel fuel.

The energy fortified diesel fuel of the present invention has good compression ignition behavior, high volumetric energy density, and good thermal and oxidative stability even without the addition of a stabilizer as evidenced by its stability in the Modified Dupont F21-61 ninety minute stability test at 300° F. In fact, it is more stable than other diesel fuel blends with additives having lower boiling points, such as blends of LCO and on-highway diesel fuel. Because of its excellent stability, it is resistant to sludge formation. Its API gravity is about 30 or less, and thus, its volumetric energy density is 133,000 Btu/gallon or greater. Its acceptable compression ignition behavior is indicated by the fact that its cetane number/index is about 30 or greater. Still further, it has excellent cold flow properties as evidenced by it having a cloud point and a pour point which meet typical requirements for off-highway heavy duty compression ignition engines. In addition, it has a low tendency to form foam, which is helpful, for example, in permitting higher fueling rates and more complete and reliable fillings of fuel tanks.

The energy fortified diesel fuel of the present invention contains no more than low amounts of contaminants such as ash, sulfur, asphaltenes, particulates, Ramsbottom carbon, metals, high boiling compounds, non-vaporizable components and other non-carbon and hydrogen heteroatomic constituents. The amount of these contaminants in the energy fortified diesel fuel of the present invention is substantially lower than the amount of such contaminants in bunker fuel. Specifically, the energy fortified diesel fuel has an ash content not greater than about 0.04 weight a sulfur content of not greater than about 0.5 weight %, and a Ramsbottom carbon less than about 1 weight % for the fuel. It has a maximum viscosity of about 20 cst at 100° F., which is substantially lower than the viscosity of bunker fuel. The energy fortified diesel fuel of the present invention has a flash point of at least 125° F. and can be blended to have significantly higher flash points. It has a higher carbon to hydrogen ratio than on-highway diesel fuel, a No. 3 maximum corrosion, and an ASTM D-1500 color of 4 or less if desired. Temperatures greater than about 640° F. must be used to vaporize about 90% of the energy fortified diesel fuel of the present invention. Preferably, the energy fortified diesel fuel is formulated so that about 90% vaporizes at temperatures between about 675 and 800° F.

The hydrocarbon additive is derived from a heavy hydrocarbon fraction. This heavy hydrocarbon fraction used in formulating the energy fortified diesel fuel of the present invention is comprised of slurry oil or heavy cycle oil obtained from a Fluid Catalytic Cracker (FCC) unit or a heavy hydrocarbon fraction obtained from a steam cracker unit. The slurry oil or heavy cycle oil may also be referred to as clarified oil. The properties of the specific heavy hydrocarbon fraction used are the most important guide to operating conditions and procedures for the various steps in the process.

The heavy hydrocarbon fraction is distilled to remove contaminants, like ash, sulfur, high boiling compounds and other impurities. Preferably, the heavy hydrocarbon fraction is distilled or fractionated at a temperature between about 500 and 750° F. and at a pressure between about 1 mm Hg and 10 psig. Most preferably, this is a vacuum distillation. Contaminates, including substantial amounts of sulfur, remain in the bottoms of the distillation. The distillate can be a substantial part of the heavy fraction hydrocarbon feed, depending upon the specific properties of the feed. Typically, the distillate is between about 10 and 60% of the heavy fraction hydrocarbon feed. Where a distillate having properties closer to those of on-highway diesel fuel is required, lower cuts of distillate, such as 40% or less, may be taken. The distillate is the energy fortified hydrocarbon additive of the present invention wherein greater than about 50% of the hydrocarbon additive vaporizes at or above about 650° F. This hydrocarbon additive has a high specific gravity and, thus, a high volumetric energy density which is typically above about 145,000 Btu/gallon. Furthermore, this energy fortified hydrocarbon additive or blend component can be produced at lower costs than blend components which have boiling points within or nearly within the ASTM diesel fuel specifications.

The hydrocarbon additive is mixed with diesel fuel of which about 90% vaporizes at or below about 640° F. or about 95% vaporizes at or below about 698° F. (or a comparable lower boiling range fraction) to form the energy fortified diesel fuel of the present invention. This diesel fuel could be ASTM D 975 type diesel fuel. The hydrocarbon additive and the diesel fuel can be combined in various proportions. The blend can be adjusted to provide desirable compression ignition behavior for certain applications and a specified volumetric energy density. The mixture can be about 55% or less of the hydrocarbon additive. Typically, it is 25% or less hydrocarbon additive for applications such as railroad locomotives. The hydrocarbon additive may be transported to a customer's fuel station and then blended with diesel fuel in the tanks at the fuel station or the energy fortified diesel can be blended before it is transported to customers.

The heavy fraction of hydrocarbons used in making the hydrocarbon additive can be obtained from crude oil in numerous ways. One method involves distilling crude oil at atmospheric pressure to produce atmospheric reduced crude from the bottoms of the distillation. The atmospheric reduced crude is then fed to a vacuum distillation column where vacuum gas oil is obtained in the overhead stream of this distillation. The vacuum gas oil is then fed to an FCC unit where it is cracked and fractionated. In the alternative, atmospheric reduced crude or a vacuum gas oil/atmospheric reduced crude blend may be fed to the FCC unit for cracking and fractionation.

The product from the FCC unit contains fractions of light olefins, gasoline, LCO and a heavy hydrocarbon fraction, such as slurry oil or heavy cycle oil. The heavy hydrocarbon fraction remaining in the bottoms of the FCC unit is removed. The resulting energy density of this heavy hydrocarbon fraction can be affected by operation of the FCC unit. Operation of the FCC unit at relatively high severity, for example, higher temperatures with a higher catalyst to hydrocarbon ratio, will yield products with higher energy densities and higher carbon to hydrogen ratios.

Another method of obtaining a heavy hydrocarbon fraction from crude oil involves distilling crude oil at atmospheric pressure to produce naphtha or light gas oil. This naphtha or light gas oil is then fed into a steam cracker unit which produces, among other products, ethylene, propylene, pyrolysis gasoline, and a pyrolysis distillate, which boils at a higher temperature than the pyrolysis gasoline. The pyrolysis distillate, which is a heavy hydrocarbon fraction, is removed from the steam cracker unit.

An additional step may be added to the invented process in order to remove additional sulfur from the hydrocarbon additive. The vacuum gas oil, the naphtha or the light gas oil may be hydrotreated before it is fed into the FCC unit or the steam cracker unit. Through hydrotreating, the hydrocarbons can be desulfurized so as to achieve any sulfur level. The hydrotreating process involves placing the heavy hydrocarbon fraction in a fixed bed catalyst unit at high pressure in an atmosphere of hydrogen gas. Sulfur is removed in the form of hydrogen sulfide ($H_2S$). Also, aromatic compounds are hydrogenated or saturated creating compounds with higher hydrogen contents. The more hydrogenated a compound is, the better chance the FCC unit or steam cracker unit has of cracking it.

When the hydrotreated hydrocarbons are placed in an FCC unit or a steam cracker unit, cracking product selectivity is improved. More alkyl groups are cracked as compared with feed stock which has not been hydrotreated. As a result, less bottoms yield is obtained when hydrotreated feed stock is used, but more of the bottoms obtained is comprised of more aromatic and higher density compounds, which is desirable because such a bottoms has a higher volumetric energy density than bottoms created from feed stock which has not been hydrotreated.

Those skilled in the art would not expect that high energy materials could be produced economically from a heavy hydrocarbon fraction because one would expect that when the heavy hydrocarbon fraction is distilled, the bottoms fraction, which is not used in the formulation of the present invention, would have such a high viscosity that it could not be sold. Surprisingly, the bottoms' viscosity is approximately equal to the viscosity of the heavy cut of hydrocarbons before it is distilled. If the bottoms' viscosity is slightly higher, minimal amounts of light cutter stock may be added to the bottoms to lower its viscosity. Examples of cutter stock are LCO fractions, No. 1 fuel oil (meeting ASTM D 975 specifications for classification as No. 1 diesel fuel), heavy naphtha and other hydrocarbons having viscosities lower than the bottoms fraction.

The following are examples of energy fortified diesel fuel formulations which are within the scope of this invention. These examples are not meant in any way to limit the scope of this invention.

EXAMPLE 1

A sample of slurry oil from the bottoms of an FCC fractionator was distilled until 40% of the slurry oil was in the overhead stream. This distillate is the energy fortified hydrocarbon additive of the present invention. It had an API gravity of −1.8, 50% of it vaporized at 775° F., and 90% of it vaporized at 838° F. This hydrocarbon additive was blended with a sample of No. 2 diesel fuel (formulated to meet ASTM D 975 specifications for classification as No. 2 diesel fuel) from Koch Refining Company, L. P., Pine Bend Refinery, P.O. Box 64596, St. Paul, Minn. 55162. The No. 2 diesel fuel had an API gravity of 30.5, 50% of it vaporized at 549° F., 90% of it vaporized at 643° F., a cetane index of 44.01, a cloud point of 10° F., a pour point of −6.5° F., 0.043 weight % sulfur, a viscosity of 3.65 cst at 100° F., and a Ramsbottom carbon of 0.15 weight % for the 10% bottoms residue. Fifteen percent of the hydrocarbon additive was blended with 85% of the No. 2 diesel fuel to obtain an energy fortified diesel fuel.

This energy fortified diesel fuel showed acceptable stability in the Modified Dupont F 21-61 ninety minute stability test at 300° F. Its stability was further enhanced by the addition of an antioxidant stabilizer, namely Octel FAO 31 A, in a quantity of 7.5 pounds per 1000 barrels of energy fortified railroad diesel fuel.

The compression ignition behavior of this product was well within the range predicted to be suitable for off-highway heavy duty compression ignition engines. This energy fortified diesel fuel had an API gravity of 26.06, a volumetric energy density of 135,500 Btu/gallon, 90% of it vaporized at 702.5° F., a cetane index of 36.2, a sulfur content of 0.2605 weight %, a viscosity of 5 cst at 100° F., and a Ramsbottom carbon of 0.3675 weight % for the 10% bottoms residue.

EXAMPLE 2

A sample of heavy cycle oil from an FCC fractionator was distilled until 30% of the heavy cycle oil was in the overhead stream. This distillate is the energy fortified hydrocarbon additive of the present invention. This hydrocarbon additive was blended with a sample of No. 2 diesel fuel from the Pine Bend Refinery. Twelve percent of the hydrocarbon additive was blended with 88% of the No. 2 diesel fuel to obtain an energy fortified diesel fuel.

This energy fortified diesel fuel showed acceptable stability in the Modified Dupont F 21-61 ninety minute stability test at 300° F. Its stability was further enhanced by the addition of an antioxidant stabilizer, namely Octel FAO 31 A, in a quantity of 7.5 pounds per 1000 barrels of energy fortified railroad diesel fuel.

The compression ignition behavior of this product was well within the range predicted to be suitable for off-highway heavy duty compression ignition engines. This energy fortified diesel fuel had an API gravity of 26.3, a volumetric energy density of 135,250 Btu/gallon, a flash-point of 198° F., 90% of it vaporized at 752° F., a sulfur content of 0.1382 weight %, a Conradson carbon residue of 0.2 weight % on the 10% bottoms residue, and a cetane index of 38.04. It further had a specific gravity of 0.8967, a viscosity of 4.3 cst at 100° F., a final boiling point of 848° F., a cloud point of 4° F., a pour point of −9° F., an ASTM D-1500 color that starts out at 2 and goes to 4.5 after aging, and a 3 Brown rating in the Modified Dupont F21-61 ninety minute stability test at 300° F.

EXAMPLE 3

A sample of slurry oil from an FCC fractionator was distilled until 20% of the slurry oil was in the overhead stream. This distillate is the energy fortified hydrocarbon additive of the present invention. It had an API gravity of 1.3, 50% of it vaporized at 775° F., and 90% of it vaporized at 838° F. This hydrocarbon additive was blended with a sample of No. 2 diesel fuel from the Pine Bend Refinery. Ten percent of the hydrocarbon additive was blended with 90% of the No. 2 diesel fuel to obtain an energy fortified diesel fuel.

This energy fortified diesel fuel showed acceptable stability in the Modified Dupont F 21-61 ninety minute stability test at 300° F. Its stability was further enhanced by the addition of an antioxidant stabilizer, namely Octel FAO 31 A, in a quantity of 7.5 pounds per 1000 barrels of energy fortified railroad diesel fuel.

The compression ignition behavior of this product was well within the range predicted to be suitable for off-highway heavy duty compression ignition engines. This energy fortified diesel fuel had an API gravity of 26.08, a volumetric energy density of 135,500 Btu/gallon, 50% of it vaporized at 540° F., 90% of it vaporized at 675° F., and a cetane index of 37.8.

EXAMPLE 4

A sample of clarified oil from an FCC fractionator was distilled until 40% of the slurry oil was in the overhead stream. This distillate is the energy fortified hydrocarbon additive of the present invention. It had an API gravity of −1.8, 50% of it vaporized at 775° F., and 90% of it vaporized at 838° F. This hydrocarbon additive was blended with a sample of No. 2 diesel fuel from the Pine Bend Refinery. Thirty percent of thy hydrocarbon additive was blended with 70% of the No. 2 diesel fuel to obtain an energy fortified diesel fuel.

This energy fortified diesel fuel showed acceptable stability in the Modified Dupont F 21-61 ninety minute stability test at 300° F. Its stability was further enhanced by the addition of an antioxidant stabilizer, namely Octel FAO 31 A, in a quantity of 7.5 pounds per 1000 barrels of energy fortified railroad diesel fuel.

The compression ignition behavior of this product was well within the range predicted to be suitable for off-highway heavy duty compression ignition engines. This energy fortified diesel fuel had an API gravity of 21.62, a volumetric energy density of 138,000 Btu/gallon, 90% of it vaporized at 750° F., a cetane index of 31, a sulfur content of 0.3691 weight %, a viscosity of 10 cst at 100° F., and a Ramsbottom carbon of 0.153 weight % for the 10% bottoms residue.

EXAMPLE 5

A sample of heavy cycle oil from an FCC fractionator was distilled until 20% of the heavy cycle oil was in the overhead stream. This distillate is the energy fortified hydrocarbon additive of the present invention. It had an API gravity of 1.3, 50% of it vaporized at 775° F., and 90% of it vaporized at 838° F. This hydrocarbon additive was blended with a sample of No. 2 diesel fuel from the Pine Bend Refinery. Twenty percent of the hydrocarbon additive was blended with 80% of the No. 2 diesel fuel to obtain an energy fortified diesel fuel.

This energy fortified diesel fuel showed acceptable stability in the Modified Dupont F 21-61 ninety minute stability test at 300° F. Its stability was further enhanced by the addition of an antioxidant stabilizer, namely Octel FAO 31 A, in a quantity of 7.5 pounds per 1000 barrels of energy fortified railroad diesel fuel.

The compression ignition behavior of this product was well within the range predicted to be suitable for off-highway heavy duty compression ignition engines. This energy fortified diesel fuel had an API gravity of 23.4, a volumetric energy density of 137,000 Btu/gallon, 50% of it vaporized at 560° F., 90% of it vaporized at 685° F., and a cetane index of 35.2.

EXAMPLE 6

A sample of a clarified oil from an FCC unit was distilled until 40% of the heavy hydrocarbon fraction was in the overhead stream. This distillate is the energy fortified hydrocarbon additive of the present invention. It had an API gravity of −1.8, 50% of it vaporized at 775° F., and 90% of it vaporized at 838° F. This hydrocarbon additive was blended with a sample of No. 2 diesel fuel from the Pine Bend Refinery. Ten percent of the hydrocarbon additive was blended with 90% of the No. 2 diesel fuel to obtain an energy fortified diesel fuel.

This energy fortified diesel fuel showed acceptable stability in the Modified Dupont F 21-61 ninety minute stability test at 300° F. Its stability was further enhanced by the addition of an antioxidant stabilizer, namely Octel FAO 31 A, in a quantity of 7.5 pounds per 1000 barrels of energy fortified railroad diesel fuel.

The compression ignition behavior of this product was well within the range predicted to be suitable for off-highway heavy duty compression ignition engines. This energy fortified diesel fuel had an API gravity of 26.6, a volumetric energy density of 135,000 Btu/gallon, 50% of it vaporized at 540° F., 90% of it vaporized at 680° F., and a cetane index of 37.8.

EXAMPLE 7

A sample of a clarified oil from an FCC unit was distilled until 40% of the heavy hydrocarbon fraction was in the overhead stream. This distillate is the energy fortified hydrocarbon additive of the present invention. It had an API gravity of −1.8, 50% of it vaporized at 775° F., and 90% of it vaporized at 838° F. This hydrocarbon additive was blended with a sample of No. 2 diesel fuel from the Pine Bend Refinery. Twenty percent of the hydrocarbon additive was blended with 80% of the No. 2 diesel fuel to obtain an energy fortified diesel fuel.

This energy fortified diesel fuel showed acceptable stability in the Modified Dupont F 21-61 ninety minute stability test at 300° F. Its stability was further enhanced by the addition of an antioxidant stabilizer, namely Octel FAO 31 A, in a quantity of 7.5 pounds per 1000 barrels of energy fortified railroad diesel fuel.

The compression ignition behavior of this product was well within the range predicted to be suitable for off-highway heavy duty compression ignition engines. This energy fortified diesel fuel had an API gravity of 23.1, a volumetric energy density of 137,100 Btu/gallon, 50% of it vaporized at 560° F., 90% of it vaporized at 725° F., and a cetane index of 34.6.

A sample of a heavy hydrocarbon fraction from a steam catalytic cracker may also be distilled, and the distillate may be used as the hydrocarbon additive of the present invention. It may be combined with No. 2 diesel fuel to form an energy fortified diesel fuel of the present invention. These components may be combined, for example, in proportions similar to the combinations of hydrocarbon additive and diesel fuel in Examples 1–7.

The volumetric energy density of the energy fortified diesel fuel of the present invention is much greater than on-highway diesel fuels and approaches bunker fuel values. This is important since diesel fuel is purchased on a volume basis, and therefore, fuel costs are decreased if energy fortified diesel fuel costs the same as conventional on-highway diesel fuel. Since the energy fortified diesel fuel of the present invention can be produced at lower costs than conventional on-highway diesel fuel, it should cost less and thus further decrease fuel costs for off-highway engines. Still further, the energy fortified diesel fuel of the present invention eliminates the problems of bunker fuel and satisfies combustion efficiency requirements for off-highway engines. In addition, the energy fortified diesel fuel of the present invention is able to provide significant energy fortification with small amounts of hydrocarbon additive, and the hydrocarbon additive has a negligible effect on compression ignition performance and stability.

The energy fortified diesel fuel of the present invention is useful in a variety of off-highway applications. It is useful in "very" heavy duty compression ignition engines, such as marine diesel engines, in place of bunker fuel because it is less abusive to equipment and is less likely to harm the engine than bunker fuel. It is also useful in heavy duty compression ignition engines, such as locomotive engines, since its cetane number and API gravity are optimized for these types of engines.

From the foregoing, it will be seen that this invention is one well-adapted to attain all the ends and objects hereinabove set forth together with other advantages which are obvious and which are inherent. It will be understood that certain features and subcombinations are of utility and may be employed without reference to other features and subcombinations. This is contemplated by and is within the scope of the claims. Since many possible formulations and process variations of the invention may be made without departing from the scope thereof, it is to be understood that all matter herein set forth is to be interpreted as illustrative and not in a limiting sense.

We claim:

1. An energy fortified diesel fuel, comprising a mixture of:

a hydrocarbon additive that is the distillate of a heavy hydrocarbon fraction wherein greater than about 50% of said hydrocarbon additive vaporizes at or above about 650° F.; and a diesel fuel component wherein about 90% of said diesel fuel vaporizes at or below about 640° F., or wherein about 95% of said diesel fuel vaporizes at or below about 698° F.

2. The energy fortified diesel fuel as in claim 1, wherein greater than about 50% of said hydrocarbon additive vaporizes at or above about 670° F.

3. The energy fortified diesel fuel as in claim 1, wherein greater than about 50% of said hydrocarbon additive vaporizes at or above about 700° F.

4. The energy fortified diesel fuel as in claim 1, wherein said energy fortified diesel fuel is comprised of about 55% or less of said hydrocarbon additive.

5. The energy fortified diesel fuel as in claim 1, wherein said energy fortified diesel fuel is comprised of about 25% or less of said hydrocarbon additive.

6. The energy fortified diesel fuel as in claim 1, wherein said energy fortified diesel fuel is comprised of about 15% of said hydrocarbon additive and about 85% of said diesel fuel.

7. The energy fortified diesel fuel as in claim 1, wherein said energy fortified diesel fuel is comprised of about 10% of said hydrocarbon additive and about 90% of said diesel fuel.

8. The energy fortified diesel fuel as in claim 1, further comprising a stabilizer mixed with the mixture of said hydrocarbon additive and said diesel fuel component.

9. The energy fortified diesel fuel as in claim 8, wherein said energy fortified diesel fuel is comprised of about 50 pounds or less of said stabilizer per 1000 barrels of said energy fortified diesel fuel.

10. The energy fortified diesel fuel as in claim 1, wherein said diesel fuel component has an API gravity at least about 30, a flash point of at least about 125° F., and a cetane number of at least about 40.

11. The energy fortified diesel fuel as in claim 1, wherein said energy fortified diesel fuel has a cetane number of at least about 30, a volumetric energy density of greater than about 133,000 Btu/gallon, a carbon to hydrogen ratio of between about 0.50 and 1.00, a flash point of at least about 125° F., an API gravity of at least about 20, and a maximum viscosity of about 20 cst at 100° F.

12. The energy fortified diesel fuel as in claim 1, wherein less than 0.5 weight percent sulfur is included in said mixture.

13. The energy fortified diesel fuel as in claim 1, wherein said hydrocarbon additive is derived from slurry oil or heavy cycle oil obtained from an FCC unit or a heavy hydrocarbon fraction obtained from a steam cracker unit.

14. Of The energy fortified hydrocarbon additive as in claim 13, wherein said hydrocarbon additive has a volumetric energy density greater than 145,000 Btu/gallon.

15. The energy fortified hydrocarbon additive as in claim 13, wherein said hydrocarbon additive has a volumetric energy density between about 148,000 and 154,000 Btu/gallon.

16. The energy fortified hydrocarbon additive as in claim 13, wherein said hydrocarbon additive has a carbon to hydrogen ratio of greater than about 0.8.

17. The energy fortified hydrocarbon additive as in claim 13, wherein greater than about 50% of said hydrocarbon additive vaporizes at or above about 670° F.

18. The energy fortified hydrocarbon additive as in claim 13, wherein greater than about 50% of said hydrocarbon additive vaporizes at or above about 700° F.

19. The energy fortified hydrocarbon additive as in claim 13, wherein no more than negligible amounts of contaminants are included in said hydrocarbon additive.

20. A process for making an energy fortified hydrocarbon additive, consisting of:

(a) distilling a heavy hydrocarbon fraction consisting of slurry oil or heavy cycle oil obtained from an FCC unit or a heavy hydrocarbon fraction obtained from a steam cracker unit to remove contaminants wherein said distillation is performed at a temperature of between about 500 and 750° F. and at a pressure between about 1 mm Hg and 10 psig; and (b) removing distillate from said step (a) distillation wherein said distillate is used as an energy fortified hydrocarbon additive.

21. The product of the process of claim 20.

22. The process for making an energy fortified hydrocarbon additive as in claim 20, wherein said distillate is between about 10 and 60% of said heavy hydrocarbon fraction.

23. A process for making energy fortified diesel fuel, comprising:

(a) distilling a heavy hydrocarbon fraction to remove contaminants;

(b) removing the distillate from said step (a) distillation wherein said distillate vaporizes at or above about 650° F.; and (c) mixing said distillate with diesel fuel wherein about 90% of said diesel fuel vaporizes at or below about 640° F., or wherein about 95% of said diesel fuel vaporizes at or below about 698° F.

24. The process for making energy fortified diesel fuel as in claim 23, wherein said heavy hydrocarbon fraction is comprised of slurry oil or heavy cycle oil obtained from an FCC unit or a heavy hydrocarbon fraction obtained from a steam cracker unit.

25. The process for making energy fortified diesel fuel as in claim 23, wherein said heavy hydrocarbon fraction is obtained by distilling crude oil at atmospheric pressure to produce atmospheric reduced crude in the bottoms of the distillation, removing said atmospheric reduced crude, feeding said atmospheric reduced crude into a vacuum distillation column, obtaining vacuum gas oil in the overhead stream of said vacuum distillation, feeding said vacuum gas oil into an FCC unit wherein said vacuum gas oil is cracked and fractionated, and removing a heavy hydrocarbon fraction remaining in the bottoms of said FCC unit.

26. The process for making energy fortified diesel fuel as in claim 25, wherein said vacuum gas oil is hydrotreated before it is fed into said FCC unit.

27. The process for making energy fortified diesel fuel as in claim 25, including feeding a second amount of atmospheric reduced crude with said vacuum gas oil into the FCC unit so as to form a vacuum gas oil/atmospheric reduced crude blend and cracking and fractionating said blend.

28. The process for making energy fortified diesel fuel as in claim 23, wherein said heavy hydrocarbon fraction is obtained by distilling crude oil at atmospheric pressure to produce atmospheric reduced crude in the bottoms of the distillation, removing said atmospheric reduced crude, feeding said atmospheric reduced crude into an FCC unit wherein said atmospheric reduced crude is cracked and fractionated, and removing a heavy hydrocarbon fraction remaining in the bottoms of said FCC unit.

29. The process for making energy fortified diesel fuel as in claim 28, wherein said atmospheric reduced crude is hydrotreated before it is fed into said FCC unit.

30. The process for making energy fortified diesel fuel as in claim 27, wherein said vacuum gas oil/atmospheric reduced crude blend is hydrotreated before it is fed into said FCC unit.

31. The process for making energy fortified diesel fuel as in claim 23, wherein said heavy cut of hydrocarbons is obtained by distilling crude oil at atmospheric pressure to produce naphtha or light gas oil, feeding said naphtha or said light gas oil into a steam cracker unit, producing a heavy hydrocarbon fraction in said steam cracker unit, and removing said heavy hydrocarbon fraction.

32. The process for making energy fortified diesel fuel as in claim 31, wherein said naphtha or said light gas oil is hydrotreated before it is fed into said steam cracker unit.

33. The process for making energy fortified diesel fuel as in claim 23, wherein said distillation is performed at a temperature between about 500 and 750° F. and at a pressure between about 1 mm Hg and 10 psig.

34. The process for making energy fortified diesel fuel as in claim 23, wherein said distillate is between about 10 and 50% of said heavy hydrocarbon fraction.

35. A method for using an energy fortified diesel fuel in an off-highway compression ignition engine, comprising:

(a) making an energy fortified diesel fuel comprised of a hydrocarbon additive that is the distillate of a heavy hydrocarbon fraction and a diesel fuel component wherein said fuel has an API gravity between about 20 and 29, a volumetric energy density which is greater than about 135,000 Btu/gallon, a cetane number between about 30 and 39, a flash point of at least about 125° F., a carbon to hydrogen ratio between about 0.50 and 1.00, and a maximum viscosity of about 20 cst at 100° F.; and (b) utilizing said energy fortified diesel fuel in an off-highway heavy duty or "very" heavy duty compression ignition engine.

36. A method for using an energy fortified diesel fuel in an off-highway compression ignition engine, comprising:

utilizing the energy fortified diesel fuel of claim 1 in an off-highway heavy duty or "very" heavy duty compression ignition engine.

* * * * *